US010144576B2

(12) United States Patent
Stenberg

(10) Patent No.: US 10,144,576 B2
(45) Date of Patent: Dec. 4, 2018

(54) STACK AND METHOD OF DISPENSING

(71) Applicant: SCA Hygiene Products AB, Göteborg (SE)

(72) Inventor: Martin Stenberg, Torslanda (SE)

(73) Assignee: ESSITY HYGIENE AND HEALTH AKTIEBOLAG, Göteborg (SE)

( * ) Notice: Subject to any disclaimer, the term of this patent is extended or adjusted under 35 U.S.C. 154(b) by 0 days.

(21) Appl. No.: 14/785,674

(22) PCT Filed: Apr. 22, 2013

(86) PCT No.: PCT/SE2013/050432
§ 371 (c)(1),
(2) Date: Oct. 20, 2015

(87) PCT Pub. No.: WO2014/175791
PCT Pub. Date: Oct. 30, 2014

(65) Prior Publication Data

US 2016/0090229 A1 Mar. 31, 2016

(51) Int. Cl.
*B65D 85/62* (2006.01)
*B65D 83/08* (2006.01)
*A47K 10/42* (2006.01)

(52) U.S. Cl.
CPC ..... *B65D 83/0894* (2013.01); *A47K 10/427* (2013.01); *B65D 85/62* (2013.01); *A47K 2010/428* (2013.01)

(58) Field of Classification Search
CPC ..... A47K 10/422
USPC ..... 428/126
See application file for complete search history.

(56) References Cited

U.S. PATENT DOCUMENTS 1,508,020 A 9/1924 Horwitt
3,369,698 A * 2/1968 Scholz ..... A47K 10/421 221/48
3,960,291 A * 6/1976 Navi ..... G07F 11/14 221/232
4,487,318 A 12/1984 Roen
4,913,312 A 4/1990 Boutin
(Continued)

FOREIGN PATENT DOCUMENTS

CN 101784462 A 7/2010
EP 0 414 503 A2 2/1991
(Continued)

OTHER PUBLICATIONS

Extended European search report dated Nov. 22, 2016 issued in corresponding European patent application No. 13883325.6 (8 pages).
(Continued)

*Primary Examiner* — Gene O Crawford
*Assistant Examiner* — Ayodeji T Ojofeitimi
(74) *Attorney, Agent, or Firm* — Drinker Biddle & Reath LLP

(57) ABSTRACT

A stack including a plurality of sheets of web material is provided. The stack includes a plurality of bundles of substantially coextensive sheets of web material. Each bundle includes at least two sheets of web material of said plurality of sheets of web material. In the stack, the bundles of said plurality of bundles are alternatingly offset in relation to each other. Further, a method of dispensing at least two sheets of web material is disclosed.

16 Claims, 7 Drawing Sheets

(56) References Cited

U.S. PATENT DOCUMENTS

| | | | | |
|---|---|---|---|---|
| 5,305,881 | A | 4/1994 | Caldwell et al. | |
| 5,524,759 | A * | 6/1996 | Herzberg | B65D 75/5838 206/233 |
| 5,577,612 | A | 11/1996 | Chesson et al. | |
| 6,602,575 | B2 * | 8/2003 | Lefevre Du Grosriez | B65H 29/00 428/121 |
| 6,622,888 | B2 * | 9/2003 | Boone | A47K 10/424 221/36 |
| 7,213,807 | B2 * | 5/2007 | Blanchard, Jr. | B65H 33/10 270/58.32 |
| 7,922,035 | B2 | 4/2011 | Long et al. | |
| 7,926,680 | B2 | 4/2011 | Leitner | |
| 2001/0025856 | A1 | 10/2001 | Lefevre Du Grosriez et al. | |
| 2004/0206769 | A1 * | 10/2004 | Sanders | A47K 10/422 221/59 |
| 2005/0058807 | A1 * | 3/2005 | Hochtritt | A47K 10/42 428/126 |
| 2006/0118568 | A1 | 6/2006 | Hochtritt et al. | |
| 2008/0135571 | A1 | 6/2008 | Long et al. | |
| 2010/0090387 | A1 | 4/2010 | Takenouchi et al. | |
| 2015/0050452 | A1 * | 2/2015 | Penfield | B65H 45/24 428/124 |

FOREIGN PATENT DOCUMENTS

| | | | |
|---|---|---|---|
| JP | 2007-153439 | A | 6/2007 |
| JP | 3144982 | U | 9/2008 |
| JP | 2009-219562 | A | 10/2009 |
| WO | WO 96/03069 | A1 | 2/1996 |

OTHER PUBLICATIONS

English language translation of an Russian Office Action dated Dec. 29, 2016 in corresponding patent application No. 2015149761 (6 pages).

Second Chinese Office Action dated Dec. 4, 2017 issued in corresponding Chinese patent application No. 201380075811.1 (8 pages) and its English-language translation thereof (8 pages).

First Chinese Office Action dated Apr. 5, 2017 issued in corresponding Chinese patent application No. 201380075811.1 (8 pages) and its English-language translation thereof (9 pages).

* cited by examiner

STACK AND METHOD OF DISPENSING

CROSS-REFERENCE TO PRIOR APPLICATION

This application is a § 371 National Stage Application of PCT International Application No. PCT/SE2013/050432 filed Apr. 22, 2013, which is incorporated herein in its entirety.

The present disclosure relates to a stack including a plurality of sheets of web material. The present disclosure further relates to a method of dispensing a bundle of sheets of web material from a stack of sheets of web material.

BACKGROUND

Dispensers for dispensing sheets of web material from a stack of sheets of web material are well known. Commonly, the stack in a relevant dispenser is biased towards a dispensing opening of the dispenser such that a user may grasp a sheet of web material and dispense it from the dispenser through the dispensing opening. The stack may be biased towards the dispensing opening by means of gravity or a resilient biasing arrangement.

In some applications, one sheet at a time is dispensed from a stack in a relevant dispenser. For instance, when a restaurant customer himself dispenses a sheet of web material in the form of a napkin from a stack of napkins, it is desirable that only one napkin at a time is dispensed. In this manner, overconsumption of napkins may be avoided.

However, in other applications it is desirable that more than one sheet of web material may be dispensed from a stack in an efficient and orderly manner. This is called for in take-away and drive-through restaurants where restaurant staff provides more than one napkin with each restaurant order. Thus, dispensing a controlled amount of more than one napkin is desirable in a dispenser for such so-called back-of-the-house use.

US2001/025856 discloses a stack of supple and absorbent sheets, for example made of cellulose wadding, which include a longitudinal fold line forming a longitudinal border and at least one transverse fold line perpendicular to the longitudinal fold line. The longitudinal and transverse fold lines of an upper folded sheet in the stack are not adjacent to the respective longitudinal and transverse fold lines of the previous lower folded sheet. Thus, a symmetrical stack of sheets may be achieved.

US2006/118568 discloses a napkin dispenser including a container body for holding a stack of napkins, and a pair of interchangeable face plates each connectable to the container body. One of the face plates has a first elongated dispensing opening exposing a bottom region of the napkin stack, for one-by-one dispensing, and the other face plate has a second elongated dispensing opening exposing an edge region of the napkin stack, for dispensing a plurality of napkins simultaneously.

There exists a need for providing more than one sheet of web material to a user in an efficient and orderly manner.

SUMMARY

According to one aspect, it is desired to provide a stack of sheets of web material, from which stack more than one sheet of web material may be dispensed in an efficient and orderly manner.

According to an aspect, a stack includes a plurality of sheets of web material, and a plurality of bundles of substantially coextensive sheets of web material. Each bundle includes at least two sheets of web material of the said plurality of sheets of web material. In the stack, the bundles of the said plurality of bundles are alternatingly offset in relation to each other.

Since the sheets of web material are provided in bundles including at least two sheets of web material and the bundles are alternatingly offset in relation to each other, a user may easily grasp one bundle and dispense the bundle from the stack. Accordingly, at least two sheets of web material are easily dispensed simultaneously and provided orderly together in the bundle to a user.

It has been realized by the inventor that sheets of web material may be provided in bundles including coextensive sheets of web material in a stack of sheets of web material, the bundles being alternatingly offset in relating to each other in the stack. To the knowledge of the inventor, the problem of providing more than one sheet of web material to a user in an efficient and orderly manner has not previously been solved by arranging sheets of web material in a stack as defined above.

Due to the offset between the bundles, a user may easily grasp around an edge portion of an outermost bundle of the stack, the edge portion of the outermost bundle including edges of all the coextensive sheets of the outermost bundle. The outermost bundle of the stack is a bundle at a top of the stack, i.e. the outermost bundle is the bundle to be dispensed next from the stack. Substantially coextensive sheets of web material of a bundle entail that the sheets of web material are substantially aligned along edges of the sheets of web material. An edge of a sheet of web material may either include one or more free edges of web material and/or one or more folded edges of web material. As arranged in the stack, each sheet of web material may be an unfolded sheet of web material, or a folded sheet of web material. The web material may be a soft and absorbent sheet of web material, e.g. a sheet for general wiping purposes, or a napkin for use e.g. by restaurant customers. The stack including a plurality of sheets of web material may be arranged in a dispenser for dispensing the bundles of sheets of web material. Accordingly, the stack is suitable for placing in a dispenser.

According to embodiments, each sheet of said plurality of sheets of web material may have an extension along a first direction, and wherein the bundles may be alternatingly offset along the first direction. That is, edge portions of two adjacent bundles are offset in relation to each other along the first direction.

According to embodiments, two adjacent bundles of the plurality of bundles may be offset 0.5-5 cm, or 1-3 cm, along the first direction. In this manner, the bundles may be provided in the stack with an offset suitable for easy grasping and removing of a bundle of sheets of web material from the stack by a user.

According to embodiments, the sheets of the said plurality of sheets of web material may be identically shaped, or may have mirror-inverted shapes. In some embodiments, a mirror-inverted shape may simply relate to a different folding direction during a manufacturing process of the sheets of web material.

According to embodiments, each sheet of the said plurality of sheets of web material, as arranged in the stack, may have four straight edge portions, wherein two opposite of the four straight edge portions of each sheet of the said plurality of sheets of web material are aligned along two parallel planes in the stack. In this manner, the stack may be flush on two parallel sides of the stack, and the bundles may be offset along two other sides of the stack, the two other sides of the stack being substantially perpendicular to the two parallel sides of the stack.

According to embodiments, each sheet of the said plurality of sheets of web material may be rectangular. The shape of each sheet of web material is defined in the shape the sheet is arranged in the stack, i.e. folded or unfolded. The rectangular shape may be any rectangular shape encompassing a square shape.

According to embodiments, each sheet of the said plurality of sheets of web material may be a separate sheet of web material. In this manner, the sheets of web material in a bundle are easily separated from each other, after a bundle has been dispensed from a relevant dispenser, to facilitate end use of singular sheets of web material.

According to embodiments, each sheet of the said plurality of sheets of web material may be folded. This may be a convenient way of providing suitably sized sheets of web material for wiping purposes, such as napkins, in a conveniently sized stack.

According to embodiments, the at least two sheets of web material in each bundle may be interleaved.

According to embodiments, each bundle of the said plurality of bundles may include 2-10 sheets of web material, or 2-6 sheets of web material. In this manner, a suitable number of sheets of web material may be provided in each bundle, e.g. for sheets of web material in the form of napkins, as dispensed by restaurant staff and provided with e.g. a take-away restaurant order.

According to embodiments, each bundle of the said plurality of bundles may include a same number of sheets of web material. In this manner, the stack may be orderly formed of equal bundles.

According to embodiments, the stack may include a wrapping provided around the stack for holding the plurality of sheets of web material together. In this manner, the stack may be conveniently handled prior to being placed in relevant dispenser. The wrapping may be removed upon being place in a relevant dispenser.

According to embodiments, the stack may include six sides, and the wrapping may be provided around at least four sides of the six sides of the stack, including two sides extending along the above-mentioned two parallel planes.

According to embodiments, the wrapping may be provided around the six sides of the stack.

According to embodiments, each sheet of the said plurality of sheets of web material may form a napkin.

According to embodiments, each sheet of the said plurality of sheets of web material may include a cellulose material including new and/or recycled cellulose fibres. Each sheet of web material may be soft and absorbent.

Each sheet of web material may include wet creped web material, and/or dry creped web material, and/or TAD web material, and/or ATMOS web material. Each sheet of web material may include an embossed surface structure. The surface of each sheet of web material may be printed on. Each sheet of web material may include one or more layers of web material, typically 1-3 layers of web material. The layers may be glued together, or may be commonly embossed to connect the layers to each other, e.g. by edge embossing. Embossing may be provided in portions of the entire surface of a sheet. Each layer may be separately embossed. If a sheet of web material includes more than one layer of web material, the different layers may be of the same kind or they may form combinations of the different kinds of web material mentioned above. Each of the one or more layers of web material in a sheet of web material may have a weight of 15-30 gsm (gram per square meter). An example sheet of web material forming a napkin may be formed from 2 layers of web material, each layer having a weight of 17 gsm.

A stack according to embodiments may have a height of 10-60 cm and may include 100-1500 sheets of web material.

It is also desired to provide a method of dispensing more than one sheet of web material form a stack of sheets of web material.

According to an aspect, a method of dispensing a bundle includes at least two sheets of web material from a stack according to any aspect and/or embodiment disclosed herein. The method includes:

biasing the stack towards a dispensing opening of a dispenser, biasing the stack against a stopper element arranged in connection with the dispensing opening, exposing an edge portion of an outermost bundle in the dispensing opening, grasping the outermost bundle about the edge portion, and removing the outermost bundle from the dispensing opening and the stopper element.

Since the sheets of web material are dispensed in bundles including at least two sheets of web material and the bundles are alternatingly offset in relation to each other, a user may easily grasp one bundle and dispense the bundle from the stack and the dispenser. Thus, at least two sheets of web material are easily dispensed simultaneously and provided orderly together in the bundle to a user.

The edge portion of the outermost bundle includes edges of all the coextensive sheets of the outermost bundle.

Further features of, and advantages with, embodiments of the present invention will become apparent when studying the appended claims and the following detailed description. Those skilled in the art will realize that different features of the embodiments of the present invention may be combined to create embodiments other than those described in the following, without departing from the scope of the present invention, as defined by the appended claims.

BRIEF DESCRIPTION OF THE DRAWINGS

The various aspects of embodiments of the invention, including its particular features and advantages, will be readily understood from the following detailed description and the accompanying drawings, in which.

DETAILED DESCRIPTION

Embodiments of the present invention will now be described more fully with reference to the accompanying drawings, in which example embodiments are shown. However, this invention should not be construed as limited to the embodiments set forth herein. Disclosed features of example embodiments may be combined as readily understood by one of ordinary skill in the art to which this invention belongs. Like numbers refer to like elements throughout. Well-known functions or constructions will not necessarily be described in detail for brevity and/or clarity.

Figure 1:
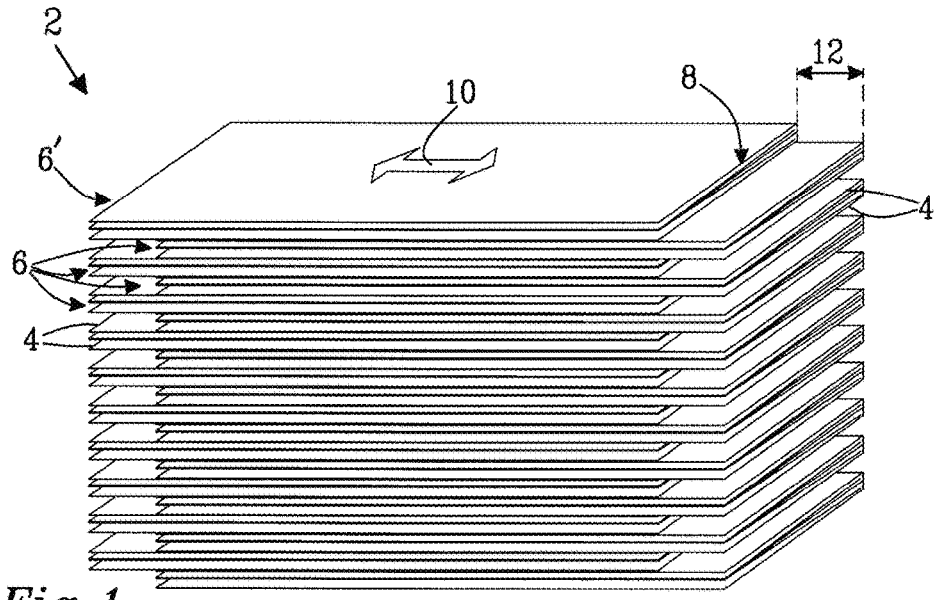
FIGS. 1 and 2 illustrate schematically embodiments of a stack including a plurality of sheets of web material.

FIG. 1 illustrates schematically embodiments of a stack 2 including a plurality of sheets 4 of web material. The sheets of web material may be sheets for general wiping purposes or napkins. In the stack 2, the sheets of web material are arranged in a plurality of bundles 6. Each bundle 6 includes at least two sheets 4 of web material. For instance each bundle 6 may include 2-10 sheets 4 of web material, or 2-6 sheets 4 of web material. In each bundle 6, the sheets 4 of web material are arranged substantially coextensively. The bundles 6 are alternatingly offset in relation to each other in the stack 2. A user, desiring to dispense sheets of web material from the stack 2, may easily grasp an outermost bundle 6' from the stack 2, i.e. a bundle at a top of the stack 2. In particular, a user may easily grasp around an edge portion 8 of the outermost bundle 6'. Since the sheets of web material of each bundle are substantially coextensive, the edge portion 8 of the outermost bundle 6' includes edge portions of all sheets of web material in the outermost bundle 6'. The same goes for each bundle 6 of the stack 2. The dispensed outermost bundle 6' includes orderly arranged sheets of web material, which may be orderly provided with restaurant food orders; in the case, the sheets of web material form napkins. The stack 2 is suitable for placing in a dispenser of the kind discussed below, for dispensing the bundles of sheets of web material.

Each sheet 4 of web material has an extension along a first direction 10. The bundles 6 are alternatingly offset along the first direction 10. Edge portions of two adjacent bundles 6 may be offset 0.5-5 cm in relation to each other, or 1-3 cm, along the first direction 10. In FIG. 1, reference number 12 indicates the offset. Each sheet 4 of web material, in the form as arranged in the stack 4, is rectangular. Each bundle 6 in the stack 2 includes a same number of sheets 4 of web material. The stack 2 may have a height of 10-60 cm and may include 100-1500 sheets 4 of web material.

Figure 2:
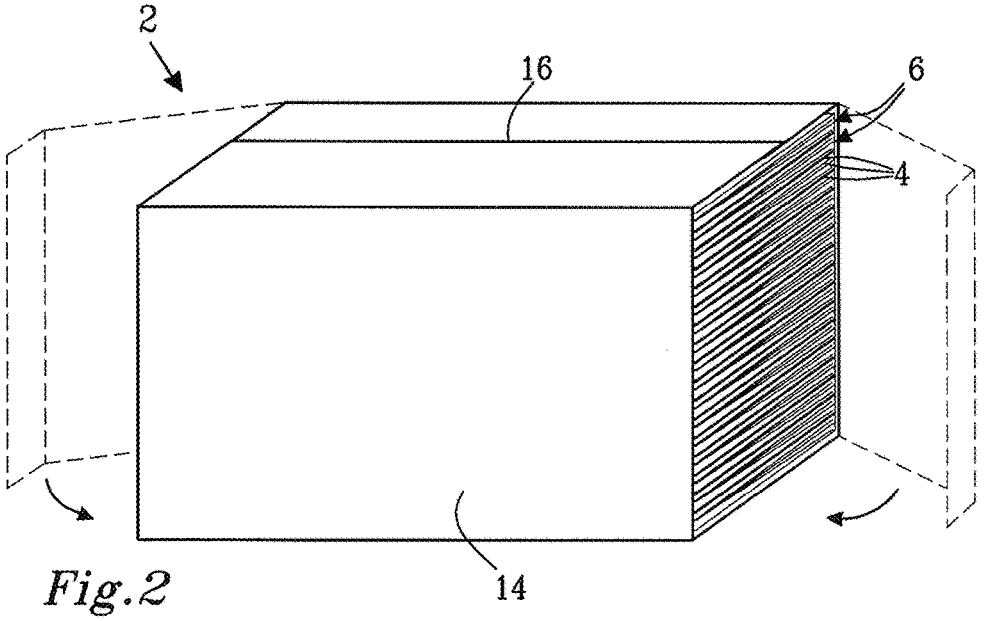

FIG. 2 illustrates schematically embodiments of a stack 2 including a plurality of sheets 4 of web material. The sheets 4 of web material may be sheets for general wiping purposes or napkins. In the stack 2, the sheets of web material are arranged in a plurality of bundles 6. Each bundle 6 includes at least two coextensive sheets 4 of web material. The bundles 6 are alternatingly offset in relation to each other in the stack 2. Each sheet 4 of web material in the stack 2 has four straight edge portions. Two opposite of the four straight edge portions of each sheet 4 of web material in the stack 2 are aligned along two parallel planes in the stack 2. As illustrated in FIG. 2, the two parallel planes extend in parallel with the plane of the drawing.

The stack 2 includes a wrapping 14 provided around the stack 2 for holding the sheets 4 of web material together. The wrapping 14 is removed upon the stack 2 being placed in a dispenser. The wrapping 14 may for instance be opened along a joint 16 of the wrapping 14. The stack includes six sides. The wrapping 14 is provided around four sides of the six sides of the stack 2. Two sides of the four sides extend along the above-mentioned two parallel planes. Alternatively, as indicated by broken lines and with curved arrows, the wrapping 14 may be provided around the six sides of the stack 2.

When the wrapping 14 is provided around only four sides of the stack 2, the warping 14 may be as wide as the stack 2, as illustrated in FIG. 2. Alternatively, the wrapping 14 may be narrower than the stack 2.

Figure 3A:
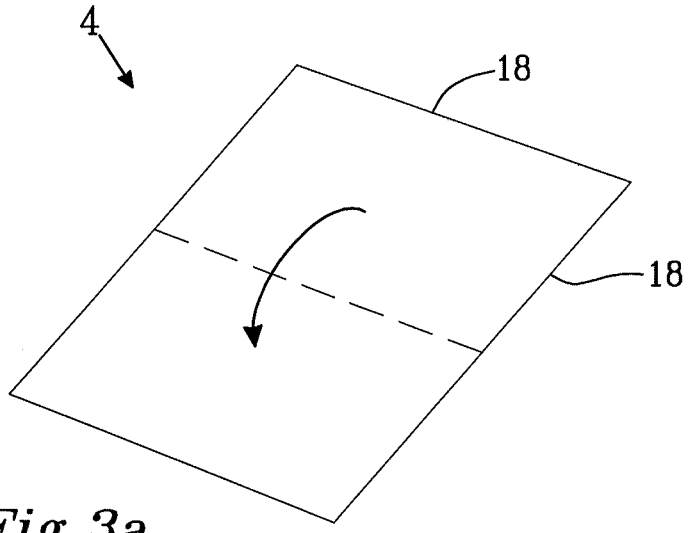
FIGS. 3*a*-3*c* illustrate sheets of web material according to embodiments.
Figure 3B:
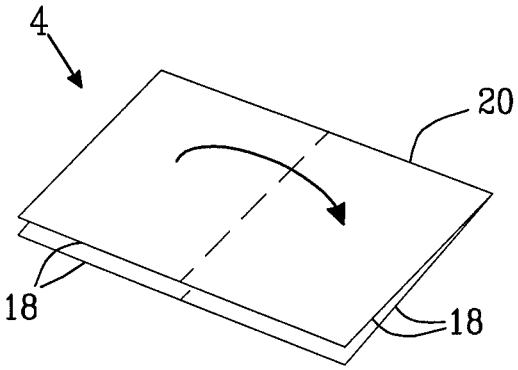
Figure 3C:
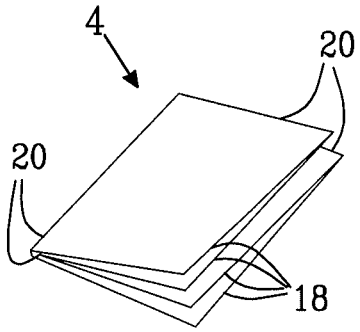

FIGS. 3*a*-3*c* illustrate sheets 4 of web material according to embodiments. Each of the sheets 4 may be arranged in a bundle 6 of a stack 2 as illustrated in FIGS. 1 and 2. A sheet 4 of web material may include a cellulose material including new and/or recycled cellulose fibres. The sheet 4 of web material is soft and absorbent. The sheet 4 of web material may include wet creped web material, and/or dry creped web material, and/or TAD web material, and/or ATMOS web material.

Each of FIGS. 3*a*-3*c* illustrates a sheet 4 of web material as it may be formed when arranged in a relevant bundle of a stack. FIGS. 3*a* and 3*b* illustrate dashed lines forming folding lines, and folding directions with arrows. Thus, folding the sheets 4 along the folding lines in the direction of the folding arrows in FIGS. 3*a* and 3*b* will result in a sheet 4 as illustrated in FIGS. 3*b* and 3*c*, respectively. FIG. 3*a* illustrates an unfolded sheet 4 of web material. FIG. 3*b* illustrates a sheet 4 of web material which has been folded once. FIG. 3*c* illustrates a sheet 4 of web material which has been folded twice. A sheet 4 of web material may thus have free edges 18 and folded edges 20.

FIGS. 3*b* and 3*c* illustrate two ways of folding a sheet 4 of web material. There are numerous alternative ways of folding sheets 4 of web material. The sheets 4 of web material of FIGS. 3*b* and 3*c* have been folded symmetrically. Alternatively, a sheet 4 of web material may be folded asymmetrically, i.e. one or more folding lines may be asymmetrically located along the sheet 4.

Figure 4A:
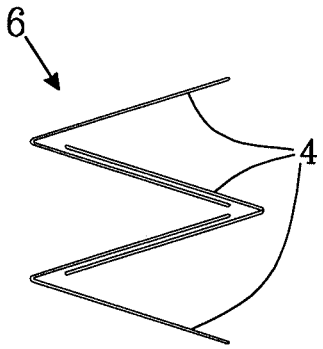
FIGS. 4*a* and 4*b* illustrate schematically expanded side views of embodiments of bundles of substantially coextensive sheets of web material.
Figure 4B:
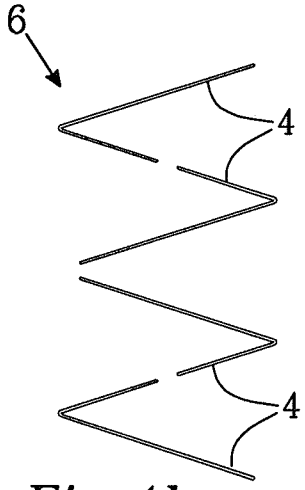

FIGS. 4*a* and 4*b* illustrate schematically expanded side views of embodiments of bundles 6 of substantially coextensive sheets 4 of web material. A number of such bundles 6, arranged alternatingly offset, form a stack of sheets 4 of web material. The bundle 6 illustrated in FIG. 4*a* includes three sheets 4 of web material. Each sheet 4 of web material is folded. The sheets 4 are interleaved in the bundle 6. The bundle 6 illustrated in FIG. 4*b* includes four sheets 4 of web material. Each sheet 4 of web material is asymmetrically folded. The sheets 4 of web material are arranged in the bundle 6 with short panels of the asymmetrically folded sheets 4 arranged such that the bundle 6 has an even thickness. Each sheet 4 of web material in the bundles of FIGS. 4*a* and 4*b* is a separate sheet of web material.

Figure 5A:
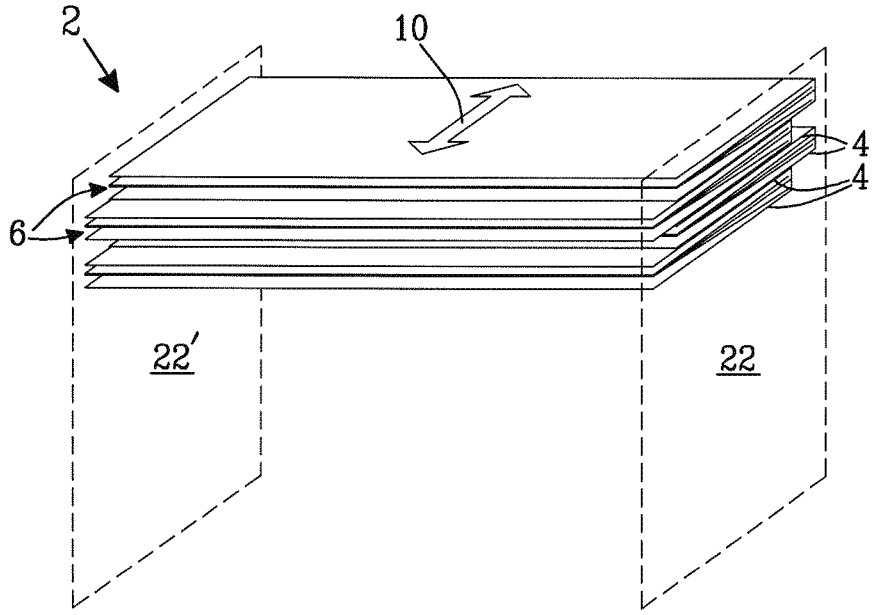
FIGS. 5*a* and 5*b* illustrate schematically embodiments of stacks including a plurality of sheets of web material.
Figure 5B:
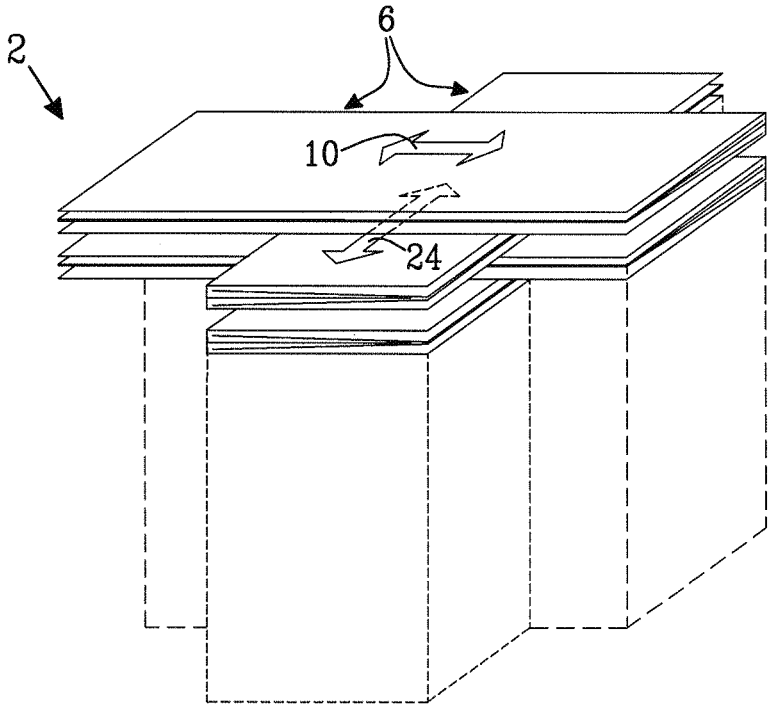

FIGS. 5*a* and 5*b* illustrate schematically further embodiments of stacks 2 including a plurality of sheets 4 of web material. The sheets 4 of web material may be sheets for general wiping purposes or napkins. In each stack 2, the sheets 4 of web material are arranged in a plurality of bundles 6. Each bundle 6 includes at least two coextensive sheets 4 of web material. The bundles 6 are alternatingly offset in relation to each other in each stack 2.

In FIG. 5*a*, only a top end of a stack 2 of sheets 4 of web material is illustrated. Each sheet 4 of web material has an extension along a first direction 10. The bundles 6 are offset along the first direction 10. In these embodiments, the first direction 10 extends across a short direction of the rectangular sheets 4, as opposed to the embodiments of FIG. 1 wherein the first direction 10 extends across a long direction of the rectangular sheets 4. Two adjacent bundles 6 may be offset 0.5-5 cm, or 1-3 cm, along the first direction 10. Each sheet 4 of web material in the stack 2 has four straight edge portions. Two opposite of the four straight edge portions of each sheet 4 of web material in the stack 2 are aligned along two parallel planes 22, 22' in the stack 2. In these embodiments, the two parallel planes 22, 22' extend along short ends of the stack 2.

In the FIG. 5*b* embodiments, each sheet 4 of web material has an extension along a first direction 10 and an extension along a second direction 24. The bundles 6 are offset along the first direction 10 and along the second direction 24, i.e. edge portions of two adjacent bundles are offset in relation to each other along both the first and second directions 10, 24.

Figure 6:
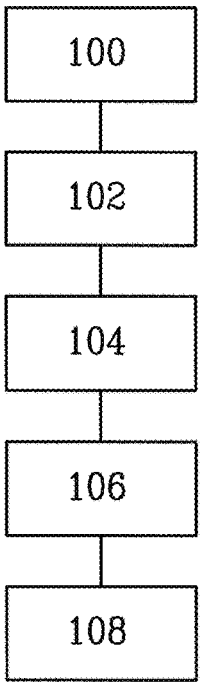
FIG. 6 illustrates a method of dispensing a bundle including at least two sheets of web material from a stack including a plurality of sheets of web material.

FIG. 6 illustrates a method of dispensing a bundle 6 including at least two sheets 4 of web material from a stack 2 including a plurality of sheets 4 of web material. The stack 2 is suitably a stack 2 according to aspects and/or embodiment disclosed herein, e.g. as disclosed in connection with FIGS. 1, 2, 5*a* and 5*b*. The method includes:

biasing 100 the stack 2 towards a dispensing opening of a dispenser, biasing 102 the stack 2 against a stopper element arranged in connection with the dispensing opening, exposing 104 an edge portion 8 of an outermost bundle 6' in the dispensing opening, grasping 106 the outermost bundle 6' about the edge portion 8, and removing 108 the outermost bundle 6' from the dispensing opening and the stopper element.

The method may be performed in connection with a dispenser according to aspects and embodiments disclosed herein.

Figure 7:
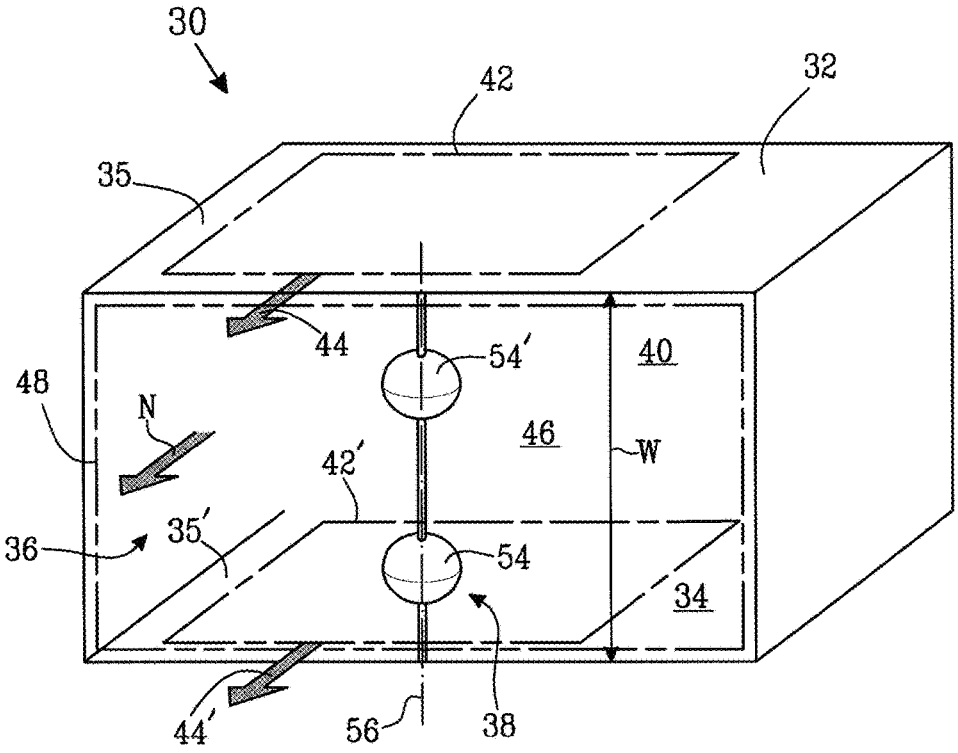
FIGS. 7-9 illustrate schematically embodiments of dispensers for dispensing sheets of web material from a stack of sheets of web material.

FIG. 7 illustrates schematically embodiments of a dispenser 30 for dispensing sheets of web material from a stack of sheets of web material. The dispenser 30 is arranged to hold a stack including a plurality of bundles of substantially coextensive sheets of web material. Each bundle includes at least two sheets of web material. In the stack, the bundles are alternatingly offset in relation to each other. Each sheet of web material may include a cellulose material including new and/or recycled cellulose fibres. The sheets of web material may be sheets for general wiping purposes or napkins. The stack may be e.g. a stack 2 as disclosed herein in connection with FIG. 1. The dispenser 30 includes a housing 32 and a web material reservoir 34 for the stack, in the housing 32. The dispenser 30 further includes a dispensing opening 36 for dispensing sheets of web material there through, a biasing arrangement (not-shown) arranged to bias the stack towards the dispensing opening 36, and a stopper element 38 associated with the dispensing opening 36. The stopper element 38 is adapted to prevent the stack from being ejected through the dispensing opening 36 by the biasing arrangement.

The web material reservoir 34 defines a stack space 40 arranged to house the stack of sheets of web material. The web material reservoir 34 has a rectangular inner cross-section. The stack space 40 is at least partially delimited between a first plane 42 and a second plane 42'. The second plane 42' is substantially parallel to and spaced a first distance from the first plane 42. Near the dispensing opening 36, the first plane 42 extends in a first plane direction 44 directed towards the dispensing opening 36 and the second plane 42' extends in a second plane direction 44' directed towards the dispensing opening 36. The dispensing opening 36 includes an opening portion 46 having an opening width W corresponding to the first distance. The opening portion 46 is substantially aligned with the stack space 40 such that the first and second plane directions 44, 44' extend uninterruptedly through the opening portion 46. Thus, the dispenser 30 is arranged to expose in the opening portion 46, an entire width of an outer sheet of web material of a stack of web material arranged in the stack space 40. A bundle of at least two sheets of web material may thus be dispensed in a direction parallel with the first and second planes 42, 42' from the dispensing opening 36.

The dispensing opening 36 extends in an opening plane 48. A normal N of the opening plane 48 extends in a direction substantially parallel with the first and second plane directions 44, 44'. The web material reservoir 34 includes a first delimiting element extending at least partially in the first plane 42 and a second delimiting element extending at least partially in the second plane 42'. In these embodiments, the first and second delimiting elements are formed by wall portions 35, 35' of the housing 32. The first and second delimiting elements border to the opening portion 46 of the dispensing opening 36. In the opening portion 46, the dispensing opening 36 is defined by the first and second delimiting elements.

Figure 8:
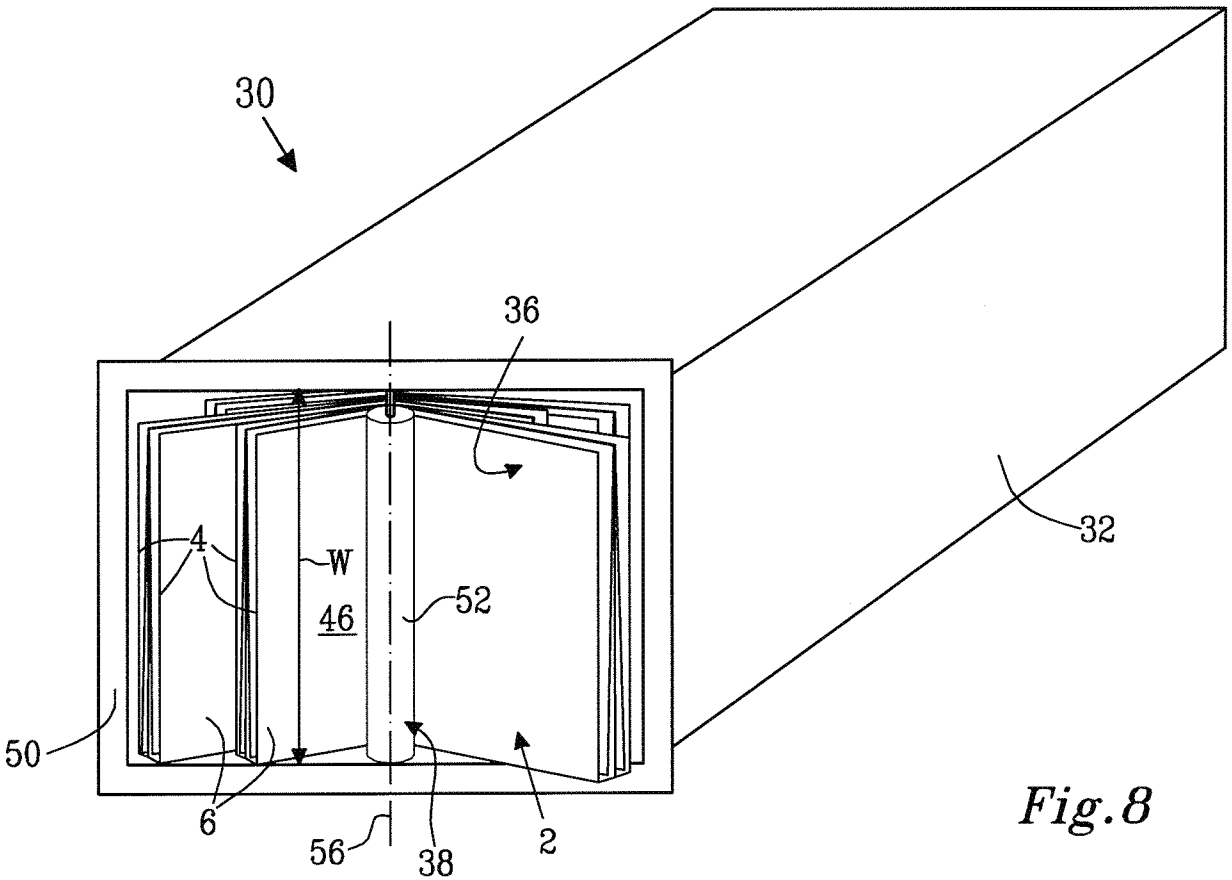

FIG. 8 illustrates schematically embodiments of a dispenser 30 for dispensing sheets of web material from a stack 2 of sheets 4 of web material. The stack 2 includes a plurality of bundles 6 of substantially coextensive sheets 4 of web material. Each bundle 6 includes at least two sheets 4 of web material. For instance, each bundle 6 may include 2-10 sheets 4 of web material, or 2-6 sheets 4 of web material. In the stack 2, the bundles 6 are alternatingly offset in relation to each other. The sheets 4 of web material may be sheets for general wiping purposes or napkins. The dispenser 30 is similar to the dispenser 30 described in connection with FIG. 7. The main difference between the FIG. 7 and FIG. 8 embodiments lies in the design of the stopper element 38. Thus, not all features of the dispenser 30 are repeated below in the description relating to the FIG. 8 embodiments.

The stack 2 is housed in a stack space of a web reservoir of the dispenser 30. The stopper element 38 prevents the stack 2 from being ejected through the dispensing opening 36 by a biasing element arranged in the dispenser 30. Again, the stack space is at least partially delimited between a first plane and a second plane arranged at a first distance from each other. The first and second planes extend in a respective first and second plane direction towards the dispensing opening 36, as discussed above. The dispensing opening 36 includes an opening portion 46 having an opening width W corresponding to the first distance. The opening portion 46 is substantially aligned with the stack space such that the first and second plane directions extend uninterruptedly through the opening portion 46. Thus, in the opening portion 46, an entire width of an outer sheet of web material of the stack 2 of web material is exposed. Edge portions of the outer sheets of the stack and two corner portions bordering to the edge portions extend into or through the dispensing opening in the opening portion 46. A bundle 6 of at least two sheets 4 of web material may thus be dispensed in a direction parallel with the first and second planes from the dispensing opening 36. A user may thus grasp around an edge portion of the outermost bundle 6 of sheets 4 of web material to dispense at least two sheets 4 of web material from the dispenser 30. Thus, the dispensing opening 36 is arranged to expose an edge portion of an outermost bundle 6 of sheets 4 of web material in the stack 2, for a user to grasp around the edge portion of the outermost bundle 6 of sheets 4 of web material.

The dispenser 30 may be used as a stand-alone unit adapted to be placed on a surface, such a counter or worktop in e.g. a restaurant. Alternatively, the dispenser 30 may be placed in a counter or a worktop. For the latter, the dispenser includes a flange 50 arranged around the dispensing opening 36. The flange 50 is arranged to abut against the counter or the worktop around an opening in the counter or the worktop. For instance, the dispenser 30 may be arranged horizontally in a counter with its dispensing opening 36 facing sideways, or vertically in a worktop with its dispensing opening 36 facing upwardly.

In the embodiments of FIGS. 7 and 8, the stopper element is arranged in a middle portion of the dispensing opening 36. The stopper element 38 extends substantially perpendicularly to the first and second planes 42, 42'. The stopper element 38 includes at least one roller 52, 54 arranged to abut against an outermost sheet of web material of the stack 2 of web material. The roller 52, 54 is arranged to rotate about a rotation axis 56. The rotation axis 56 extends parallel to the opening plane 48. The roller 52, 54 of the stopper element 38 is rotatable about the rotation axis 56 to facilitate dispensing a bundle 6 of sheets 4 of web material from the dispenser 30. In the embodiments of FIG. 8, the at least one roller 52 has a substantially cylindrical shape. In the embodiments of FIG. 7, the at least one roller 54 has a substantially spherical shape. In the FIG. 7 embodiments, the stopper element 38 includes a further spherical roller 54'. According to further embodiments, more than two spherically shaped rollers may be used. Also, in embodiments including cylindrical rollers, two, three or more individual rollers may be used. In embodiments including more than one roller 52, 54, the rollers may be arranged along one rotation axis 56, as illustrated. Alternatively, the rollers may be arranged to rotate about two or more rotation axes arranged in parallel with each other. According to further embodiments, the stopper element arranged in the middle portion of the dispensing opening 36 may include one or more fixed surfaces arranged to abut against an outermost sheet of web material of the stack 2 of web material, i.e. the stopper element does not include any roller 52, 54.

The dispensers 30 of the embodiments of FIGS. 7 and 8 include a non/shown biasing arrangement, e.g. as discussed in connection with FIG. 9 below.

Figure 9:
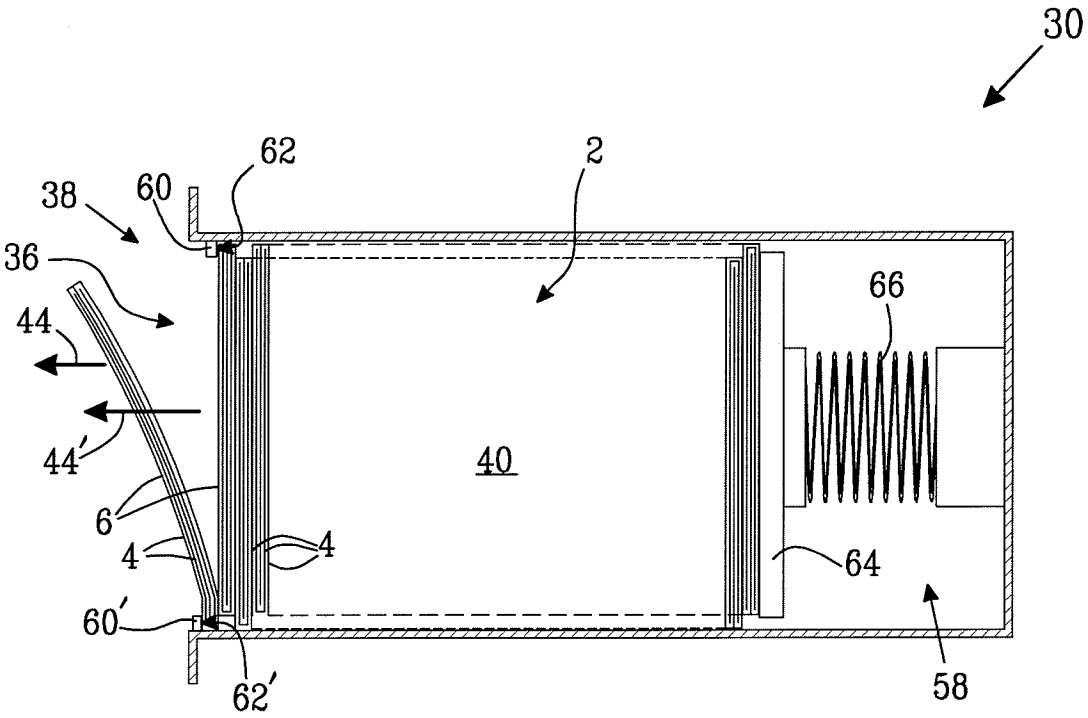

FIG. 9 illustrates a cross-section through embodiments of a dispenser 30 for dispensing sheets of web material from a stack 2 of sheets 4 of web material. Again, the stack 2 includes a plurality of bundles 6 of substantially coextensive sheets 4 of web material. Each bundle 6 includes at least two sheets 4 of web material. In the stack 2, the bundles 6 are alternatingly offset in relation to each other. The sheets 4 of web material may be sheets for general wiping purposes or napkins. The dispenser 30 is similar to the dispensers 30 described in connection with FIGS. 7 and 8. The main difference between the FIG. 9 embodiments and the FIGS. 7 and 8 embodiments lies in the design of the stopper element 38. Thus, not all features of the dispenser 30 are repeated in the description below in relation to the FIG. 9 embodiments. Similarly, features apart from the stopper element 38 described below may be applicable in dispensers 30 according to the FIGS. 7 and 8 embodiments.

The dispenser 30 includes a biasing arrangement 58 for biasing the stack 2 towards a dispensing opening 36 of the dispenser 30. A stopper element 38, arranged at the dispensing opening 36 prevents the stack 2 from being ejected through the dispensing opening 36 by the biasing arrangement 58. A web material reservoir 34 of the dispenser 30 defines a stack space 40 arranged to house the stack 2 of sheets of web material. The stack space 40 is at least partially delimited between a first plane and a parallel second plane. As illustrated in FIG. 9, the first and second planes extend in parallel with the plane of the drawing. Near the dispensing opening 36, the first plane extends in a first plane direction 44 directed towards the dispensing opening 36 and the second plane extends in a second plane direction 44' directed towards the dispensing opening 36.

The stopper element 38 includes two stopper element portions 60, 60' extending substantially perpendicularly to the first and second planes. Each stopper element portion 60, 60' is arranged at opposed ends of the dispensing opening 36. The two stopper element portions 60, 60' form together a counterpart to the biasing arrangement 58. The stopper element 38 includes a fixed surface arranged to abut against the stack 2. More specifically, each stopper element portion 60, 60' includes a fixed surface 62, 62'. Each of the fixed surfaces 62, 62' engages frictionally with a sheet of web material of the stack 2.

The second plane is spaced a first distance from the first plane. The dispensing opening 36 includes an opening portion having an opening width corresponding to the first distance. In FIG. 9, the opening width extends perpendicularly to the plane of the drawing. The opening portion of the dispensing opening is substantially aligned with the stack space 40 such that the first and second plane directions 44, 44' extend uninterruptedly through the opening portion. An outermost bundle 6 of the stack 2, frictionally engaged with one of the fixed surfaces 62, 62' thus, may be grasped by a user to dispense the bundle 6 in a direction parallel with the first and second planes from the dispensing opening 36. Thus, the dispensing opening 36 is arranged to expose an edge portion of an outermost bundle 6 of sheets 4 of web material in the stack, for a user to grasp around the edge portion of the outermost bundle 6 of sheets 4 of web material. The two outermost bundles 6 of sheets 4 of web material in the stack 2 abut each against one of the two stopper element portions 60, 60'.

The biasing arrangement 58 includes a movable wall portion 64 and a spring 66. The movable wall portion 64 abuts against a rear end of the stack 2. The spring 66 is arranged to push the movable wall portion 64 in a direction towards the dispensing opening 36. Thus, the stack 2 is biased towards the dispensing opening 36, by the biasing arrangement 58, to abut against the stopper element 38.

Provided purely as an example, the spring 66 may provide a biasing force of 0.25-0.6 N/cm. The spring 6 may be fully extended when the dispenser 30 is empty, and thus, may provide no force when the dispenser is empty. For example, when a dispenser 30, having a stack space 40 of 50 cm length, is arranged to be used horizontally, the spring 66 may provide a force of about 6-10 N when the spring 69 is fully compressed. A further example is a dispenser 30, being arranged to be used vertically with the dispensing opening facing upwardly and having a stack space 40 of 50 cm length which may house a stack weighing approximately 1.5 kg, wherein the spring 66 may provide a force of about 15 N when the spring 69 is fully compressed.

In the embodiments of FIGS. 8 and 9, the stopper element 38 extends in the opening plane 48 with an abutment surface portion of the stopper element 38 arranged substantially in the opening plane 48.

In the embodiments of FIGS. 7-9, the web material reservoir 34 is arranged to house the stack 2 with edge portions of the sheets 4 of web material in the stack 2 extending in parallel with the first and second planes 42, 42'. Planes of the sheets 4 extend substantially perpendicularly to the first and second planes 42, 42' and in parallel with the opening plane 48.

To fill the dispenser 30 with a stack 2 of sheets 4 of web material the stopper element 38 may be removed or pivoted aside for introducing the stack 2 through the dispensing opening 36. Alternatively, the dispenser 30 may be provided with a refilling opening for accessing the web material reservoir 34 and the stack space 40. According to some embodiments, a rear wall element of the housing 32 and the biasing arrangement 58 may be removed for refilling the dispenser 30.

Figure 10:
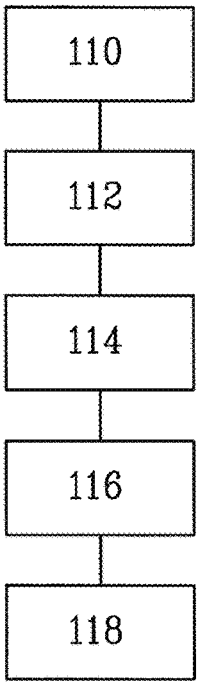
FIG. 10 illustrates a method of dispensing a bundle 6 including at least two coextensive sheets of web material from a dispenser.

FIG. 10 illustrates a method of dispensing a bundle 6 including at least two coextensive sheets 4 of web material from a dispenser 30 including a stack 2 of sheets 4 of web material, the stack 2 including a plurality of bundles 6, each bundle 6 including at least two coextensive sheets 4 of web material, wherein the bundles 6 of the plurality of bundles 6 are alternatingly offset in relation to each other. The method includes:

biasing 110 the stack 2 towards a dispensing opening 36 of the dispenser 30, biasing 112 the stack 2 against a stopper element 38 arranged in connection with the dispensing opening 36, exposing 114 an edge portion of an outermost bundle 6 in the dispensing opening 36, grasping 116 the outermost bundle 6 about the edge portion, and removing 118 the outermost bundle 6 from the dispensing opening 36 and the stopper element 38.

The method of dispensing may be performed from a dispenser 30 according to aspects and embodiments disclosed herein.

Example embodiments described above may be combined as understood by a person skilled in the art. Although the invention has been described with reference to example embodiments, many different alterations, modifications and the like will become apparent for those skilled in the art. Therefore, it is to be understood that the foregoing is illustrative of various example embodiments and that the invention is defined only the appended claims.

As used herein, the term "comprising" or "comprises" is open-ended, and includes one or more stated features, elements, steps, components or functions but does not preclude the presence or addition of one or more other features, elements, steps, components, functions or groups thereof.

The invention claimed is:

1. A stack comprising a plurality of bundles of napkins, wherein each bundle comprises at least two sheets of said napkins, wherein, in the stack:

each of said napkins includes a plurality of edges;

each of the plurality of edges of each of said napkins in each bundle are coextensive, when viewed from above, to form bundle edges; and at least one of the bundle edges of a first bundle is offset from a bundle edge of a bundle directly above or below the first bundle so that adjacent bundles do not have coextensive bundle edges, when viewed from above, and wherein all of the substantially coextensive sheets of the plurality of sheets of web material forming an uppermost bundle of said plurality of bundles are graspable and dispensable from said stack simultaneously and orderly to the user.

2. The stack according to claim 1, wherein each napkin of said plurality of napkins comprises a cellulose material comprising new and/or recycled cellulose fibres.

3. A method of dispensing a bundle comprising at least 2 sheets of web material from the stack according to claim 1, the method comprising:

biasing the stack towards a dispensing opening of a dispenser, biasing the stack against a stopper element arranged in connection with the dispensing opening, exposing an edge portion of an outermost bundle in the dispensing opening, grasping the outermost bundle about the edge portion, and removing the outermost bundle from the dispensing opening and the stopper element.

4. The stack according to claim 1, wherein each bundle of said plurality of bundles comprises 2-10 napkins.

5. The stack according to claim 1, wherein each bundle of said plurality of bundles comprises a same number of napkins.

6. The stack according to claim 1, wherein each napkin of said plurality of napkins is folded.

7. The stack according to claim 1, wherein each napkin of said plurality of napkins is a separate sheet of web material.

8. The stack according to claim 1, wherein the napkins of said plurality of napkins are identically shaped, or have mirror-inverted shapes.

9. The stack according to claim 1, wherein each napkin of said plurality of napkins, as arranged in the stack, has four straight edges, and wherein two opposite of the four straight edge portions of each napkin of said plurality of napkins are aligned along two parallel planes in the stack.

10. The stack according to claim 9, wherein each napkin of said plurality of napkins is rectangular.

11. The stack according to claim 1, further comprising a wrapping provided around the stack for holding the plurality of napkins together.

12. The stack according to claim 11, wherein the stack comprises six sides, and wherein the wrapping is provided around at least four sides of the six sides of the stack, including two sides extending along two parallel planes in the stack.

13. The stack according to claim 12, wherein the wrapping is provided around the six sides of the stack.

14. The stack according to claim 1, wherein each napkins of said plurality of napkins has an extension along a first direction, and wherein the adjacent bundles are offset along the first direction.

15. The stack according to claim 14, wherein two adjacent bundles of the plurality of bundles are offset 0.5-5 cm along the first direction.

16. A stack comprising a plurality of bundles of napkins, wherein each bundle comprises at least two sheets of said napkins, wherein, in the stack:

each of said napkins includes a plurality of edges;

each of the plurality of edges of each of said napkins in each bundle are coextensive, when viewed from above, to form bundle edges; and at least one of the bundle edges of a first bundle is offset from a bundle edge of a bundle directly above or below the first bundle so that adjacent bundles do not have coextensive bundle edges, when viewed from above, and wherein all of the substantially coextensive sheets of the plurality of sheets of web material forming an uppermost bundle of said plurality of bundles are graspable and dispensable from said stack simultaneously and orderly to the user, and wherein the at least two napkins in each bundle are interleaved.

* * * * *